US005909883A

United States Patent [19]

Jourde et al.

[11] Patent Number: 5,909,883

[45] Date of Patent: Jun. 8, 1999

[54] NEEDLING MACHINE AND ASSOCIATED FEED CONTROL METHOD

[75] Inventors: Bernard Jourde, Elbeuf; François Louis, La Saussaye; Robert Jean, Amfreville la Campagne, all of France

[73] Assignee: Asselin, Elbeuf, France

[21] Appl. No.: 08/860,823

[22] PCT Filed: Jan. 12, 1996

[86] PCT No.: PCT/FR96/00052

§ 371 Date: Aug. 11, 1997

§ 102(e) Date: Aug. 11, 1997

[87] PCT Pub. No.: WO96/21763

PCT Pub. Date: Jul. 18, 1996

[30] Foreign Application Priority Data

Jan. 12, 1995 [FR] France ..... 95 00293

[51] Int. Cl.[6] ..... D04H 18/00

[52] U.S. Cl. ..... 28/114

[58] Field of Search ..... 28/107, 108, 109, 28/110, 111, 112, 113, 114, 115

[56] References Cited

U.S. PATENT DOCUMENTS

| | | | |
|---|---|---|---|
| 3,116,534 | 1/1964 | O'Byrne | 28/107 |
| 3,391,436 | 7/1968 | Fehrer | 28/107 |
| 3,681,822 | 8/1972 | Sanders | 28/107 |
| 4,891,870 | 1/1990 | Muller | 28/113 |

FOREIGN PATENT DOCUMENTS

| | | | |
|---|---|---|---|
| 1803342 | 5/1970 | Germany | 28/107 |
| 1660776 | 4/1971 | Germany | 28/107 |

*Primary Examiner*—John J. Calvert
*Assistant Examiner*—Larry D. Worrell, Jr.
*Attorney, Agent, or Firm*—Greer, Burns, & Crain, Ltd.

[57] ABSTRACT

A needling machine for the fabrication of non woven products includes apparatus for needling a lap passing between two perforated steel plates, and introducing mechanism for introducing the fiber lap between the two plates, an extractor for extracting the lap downstream of the needling apparatus, a drive source for driving the needling apparatus with a periodical-striking motion, and a processing and control device connected to the needling drive source. The needling machine further includes an electromechanical speed control for driving at a variable speed the extractor, controlled by the processing and control device to provide the extraction means with an extraction speed modulated to the striking frequency at about an average extraction speed.

14 Claims, 3 Drawing Sheets

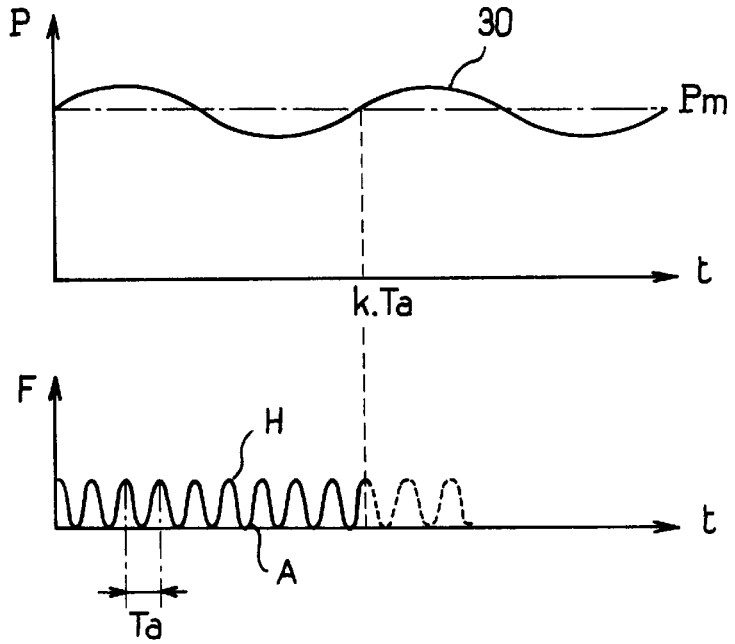
FIG_3A
FIG_3B
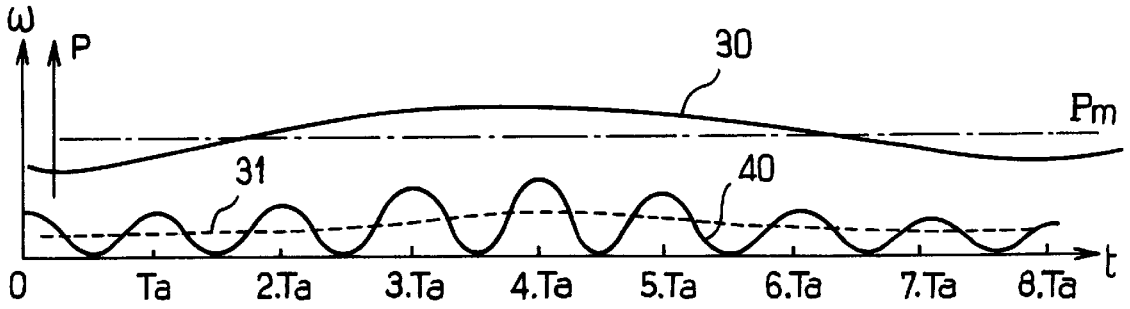
FIG_4

NEEDLING MACHINE AND ASSOCIATED FEED CONTROL METHOD

BACKGROUND OF THE INVENTION

The present invention relates to a needling machine and an associated feed control method.

The purpose of a needling machine is to mechanically consolidate a fiber fleece coming from a crosslapper or from any other system and passing between two perforated steel plates called a table and a stripper respectively. This fibre fleece is traversed by needles disposed on a support which is generally referred to as a needle board. The stripper is located facing the needle board which is driven with an alternating motion. The needles penetrate successively into the stripper, into the fibre fleece and into the table and they then carry out a reverse motion over a needling period during which the fibre fleece is displaced by a distance called the feed step. Fibre fleeces are driven in the needling machine upstream by an insertion device consisting of a first pair of rollers and downstream of the needling machine by an extraction device comprising a second pair of rollers.

In traditional needling machines, the feed movement of the fibre fleece is intermittent and takes place only when the needles are withdrawn from the product.

Now, a current development in the design of needling machines consists in increasing the striking rates and the speeds of progress of the product though the machines, in order to increase productivity. But the product to be needled is then subjected, at each stop and start of motion, to excessive accelerations which are difficult to control and which can result in degradation of the product.

From DE-A-1 660 776 there are known insertion means and extraction means driven more or less at the rhythm of the needling by means of a differential transmission coupled to the striking device. This method of driving the extraction rollers does not allow an easy and optimal modulation of the extraction speed according to the type of needled product and according to the rank of the needling machine in question in a line of machines.

The purpose of the invention is to overcome these disadvantages by proposing a needling machine which is designed to allow a modulation of the angular velocity of the extraction rollers during each needling period, this modulation being able to be of variable amplitude up to the obtaining of zero angular acceleration.

This purpose is achieved with a needling machine comprising means for needling, according to a variable striking frequency, a fibre fleece generally passing between two perforated steel plates, a first pair of rollers for inserting the fibre fleece between the two plates with an approximately constant insertion speed, a second pair of rollers for extracting the fibre fleece emerging from the plates, means of driving the needling means with a periodic striking motion, control and processing means connected to these needling drive means and electromechanical means for driving the extraction rollers at a variable speed.

SUMMARY OF THE INVENTION

According to the invention, the electromechanical driving means and the control and processing means cooperate in order to provide a modulation of the angular velocity of the extraction rollers about an average extraction speed, this modulation being of variable amplitude, in synchronism with the periodic motion of the needling means and at a frequency equal to the striking frequency.

Thus, in a needling machine according to the invention, it becomes possible to provide, thanks to the use of variable speed electromechanical means, a slowing down of the fibre fleece during the needling, which does not amount to a simple stopping of the feed. In effect, with the present invention, it is therefore no longer a matter of stop-start sequences, which limits the acceleration value of the fleece, but is a genuine modulation of the extraction speed, which will make it possible to increase the striking frequency. Furthermore, the insertion means are maintained at constant speed while the extraction means are modulated in speed, which has the effect of allowing a continuous processing of the fibre fleece. Furthermore, the adjustment of the extraction speed can be controlled by software, which contributes to an operational flexibility which would be difficult to obtain with the mechanical devices of the prior art. Furthermore, it becomes possible to modify easily the amplitude of the modulation, for example as a function of the average speed of extraction, in particular in order to reduce the amplitude when the average extraction speed is increased.

For the needling of products having a high degree of stiffness or for needling machines situated in the first rank of a line of machines, the present invention makes it possible to provide a stoppage, or at least a slowing down, of the extraction means during the needling phase. Thus, the extraction speed during a needling period can be modulated, as a function of the type of needled product and of the rank of the needling machine in question in a line of machines.

It is also possible to achieve discontinuous feed conditions in which the rotating electromechanical means and the control and processing means cooperate in order to produce in each striking period a stopping sequence of the extraction rollers corresponding to discontinuous feed conditions of the fibre fleece, this stopping sequence substantially coinciding with a needling sequence.

Furthermore, the synchronism with the periodic motion of the needling means can be advanced or delayed in order to take account of the elasticity and dampening of the textile fleece and of the dynamic characteristics of the driving system.

These discontinuous feed conditions obtained by modulation of the angular velocity are particularly suitable for products having a relatively stiff texture or for use in the first machines in a line.

Apart from these discontinuous feed conditions, the rotating electromechanical means and the control and processing means cooperate in order to procure a modulation of the angular velocity of the extraction rollers, this modulation comprising a slowing down sequence substantially coinciding with a needling sequence.

In another advantageous version of a needling machine according to the invention, the rotating electromechanical means and the control and processing means furthermore cooperate in order to procure a modulation of the feed step of the fibre fleece about a constant average feed step and with a slightly variable amplitude.

This makes it possible, by varying the real feed step about a constant average step, to make the distribution of the impacts of the needles in the fibre fleece uniform. In this way there is avoided the appearance of unwanted patterns in the needled products at feed steps required for certain textiles but which are particularly prejudicial with regard to the introduction of the needles.

In a preferred embodiment of a needling machine according to the invention, the rotating electromechanical means consist of one or more motor reduction units servo-controlled in position. These motor reduction units include a self-controlled synchronous motor with permanent magnets, or an asynchronous motor with vector flux control, or any other motor technology capable of being used within a motor-reduction unit. It is also possible to consider the use of direct drive motors for driving the extraction rollers.

According to another aspect of the invention, a method is proposed for controlling the feed of a fibre fleece in a needling machine according to the invention, characterized in that it comprises a servo-control of the position of the extraction rollers of the needling machine and an adjustment of their angular velocity.

Preferably, the adjustment of the angular velocity comprises a modulation about an average angular velocity, this modulation having a modulation frequency equal to the striking frequency and being carried out in synchronism with the periodic motion of the needling means such that the needling of the fibre fleece substantially coincides with a slowing down phase of the feed of the latter.

In the case of discontinuous feed conditions, the modulation of the angular velocity exhibits an amplitude such that the angular velocity of the extraction rollers is eliminated during the needling sequence of the fibre fleece. This method can furthermore comprise an adjustment of the phase-shift between the modulation cycles of the angular velocity and the striking cycles.

According to yet another aspect of the invention, a method is proposed for controlling the feed of a needling machine according to the invention, characterized in that it furthermore comprises a modulation of the feed step of the fibre fleece about an average feed step, this modulation being carried out at a frequency which is a sub-multiple of the striking frequency of the needling machine. This method can be combined with the preceding method and thus include a modulation of the angular velocity.

This operational system makes it possible for the result of the impacts of the needles on the product to be the sum of several different accumulated steps, which makes it possible to operate at an average feed step whose textile result could be poor in itself and which would be improved by this accumulation of steps around this average step.

This method using a modulation of the feed step is particularly suitable for needling products whose visual appearance is important or for use in finishing needling machines.

Other features and advantages of the invention will appear in the following description. In the accompanying drawings, given as non-limitative example embodiments:

BRIEF DESCRIPTION OF THE DRAWINGS

FIGS. 3A and 3B respectively show a modulation of the feed step and striking cycles corresponding to this modulation; and FIG. 4 shows the combination of a modulation of the feed step and a modulation of the angular velocity with discontinuous feed which makes it possible to improve the finished appearance of the product by cumulating different steps about the average value.

DETAILED DESCRIPTION

Figure 1:
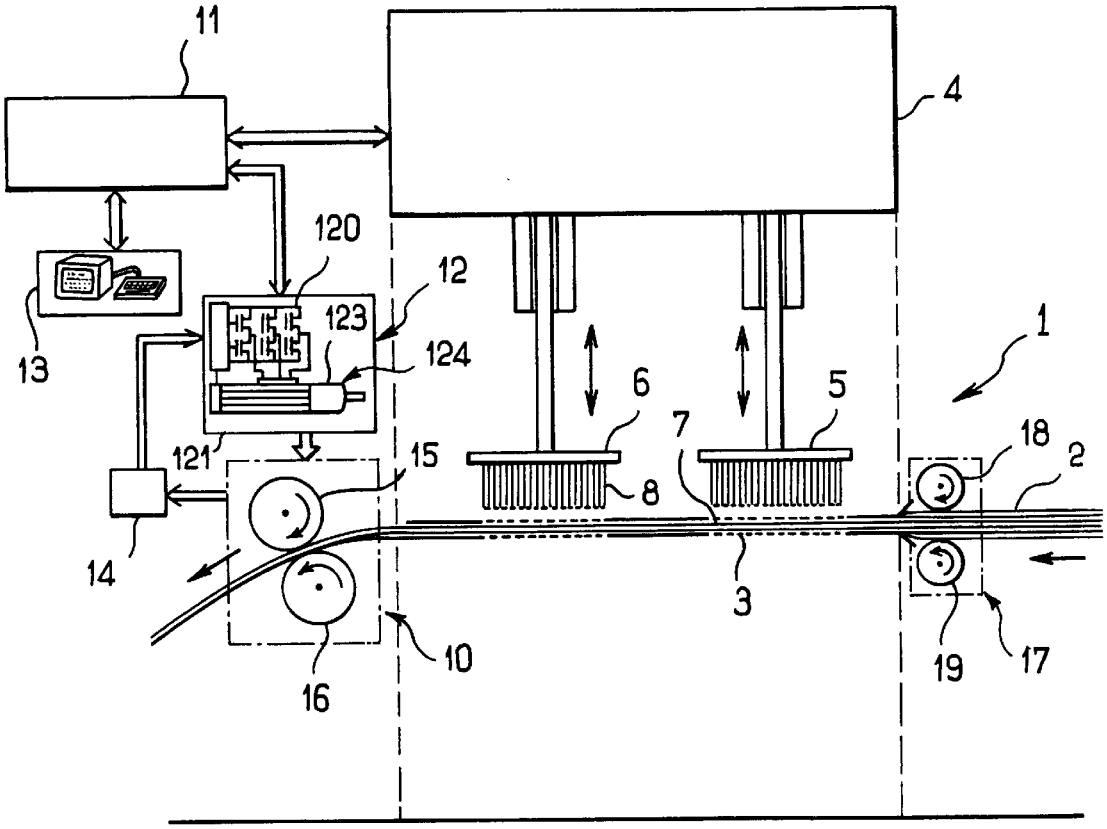
FIG. 1 is an overall view of a needling machine according to the invention.

There will now be described an example embodiment of a needling machine according to the invention at the same time as the feed control method used in this needling machine.

A needling machine 1 according to the invention comprises two parallel perforated plates 3, 7, respectively referred to as the table (lower plate) and the stripper (upper plate), between which moves a fibre fleece 2 coming from another machine (not shown) situated upstream of the needling machine 1, for example a crosslapper. This fibre fleece 2 is driven in the needling machine 1 by means of, on the one hand, insertion means 17 generally comprising a pair of rollers 18, 19 driven at a constant speed and situated at the forward end of the needling machine 1 and, on the other hand, extraction means 10 generally embodied in the form of two rollers 15, 16 which are driven by a variable speed drive device 12. The needling machine 1 furthermore comprises an assembly of needle boards 5, 6, for example two in number, which are subjected to an alternating motion perpendicular to the plane of the table and of the stripper by means of an alternating drive device 4 situated on the top of the needling machine 1 and comprising for example rod and crank assemblies. During a striking cycle, each board 5, 6 is driven with a descending vertical motion until the needles 8 penetrate into the perforations of the stripper 7, into the fibres of the fleece 2 which is therefore slowed down or even immobilized and into the perforations of the table 8. The motion of the needles continues with an ascent out of the fibre fleece 2. This fleece is subjected to a sequential displacement defined by a feed step which is the distance travelled between two needling sequences. The extraction rollers 15, 16 are driven by a variable speed electromechanical device 12 comprising a motor-reduction assembly 124, and an electronic variable power controller 120. The electromechanical device 12 is controlled by a control and processing unit 11, associated with usual interface means 13 such as a display monitor and a keyboard, this unit 11 also controlling the alternating drive device 4. The motor-reduction assembly comprises an electric motor 121 and a mechanical reduction unit 123 intended to adapt the usual nominal speeds of an electric motor to the low speeds required for driving the extraction rollers 15, 16. These extraction rollers must be servo-controlled both in speed and in position, which in practice requires the use of position coding means 14 which are connected to the electronic variable power controller 120 in order to provide this controller with data on the instantaneous position of the rollers. When a synchronous motor with permanent magnets or a vector flux controlled asynchronous motor are used, then use is made of what are now conventional and widely disclosed self-control techniques.

Figures 2A, 2B, 2C:
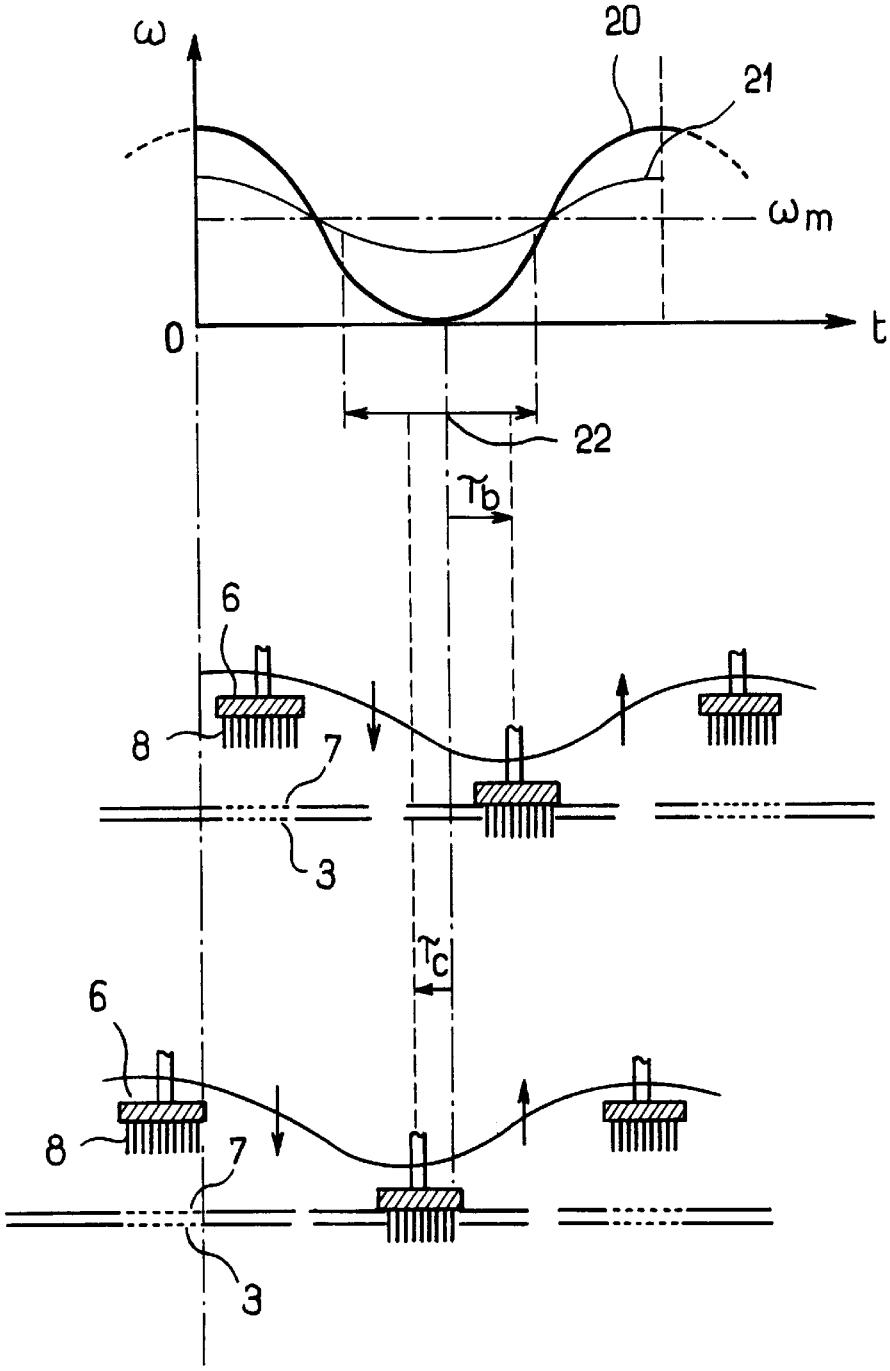
FIGS. 2A, 2B and 2C respectively show the variation in time of the angular velocity of the extraction rollers with speed modulation in operation, a first situation of advanced phase-shift of the striking cycles with respect to the slowing down cycles and a second situation of delayed phase shift of the striking cycles with respect to the slowing down cycles.

There will now be described a first feed control method used in a needling machine according to the invention such as the needling machine 1, with reference to FIGS. 2A to 2C. In this first method, it is assumed that the feed step and the striking frequency are maintained constant during the operation of the needling machine. The instantaneous angular velocity $\omega$ of the extraction rollers 15, 16 is modulated over each striking cycle according to a modulation waveform 20, 21, for example a sinusoidal waveform, about an average angular velocity $\omega_m$. This average angular velocity must be chosen with respect to the insertion speed such that it corresponds to an average flow of the product on extraction equal to the average flow of the product on insertion.

For a striking frequency below a limit frequency, it is possible to adjust the variable speed waveform 20 such that the angular velocity is eliminated, which corresponds to a stoppage of the extraction rollers and therefore to a discontinuous feed. When the striking frequency is above this limit frequency, it is then no longer possible to wait for the elimination of the angular velocity ω and the situation is then that of periodic slowing down 21. The lower part of the modulation waveform 20, 21 corresponds to a needling zone 22 during which the needles 8 penetrate into the fibre fleece 2. The limit striking frequency between the discontinuous feed conditions and the slowing down conditions depends on the maximum acceleration which the motor-reduction unit 124 can provide, which itself depends on the inertia of all of the driven mechanical parts, on the reduction ratio and on the maximum torque of the motor. Furthermore, it is also possible to define a limit average feed speed beyond which, for a given striking frequency, it is no longer possible to obtain discontinuous feed conditions.

Because of the flexibility of control offered by the use of an electronic variator and a variable speed motor, it becomes possible to control with precision the phase-shift between the striking cycle or needling cycle and the feed speed modulation cycle. In effect, it is possible to program the control and processing unit 11 in order to synchronise the two cycles and to predetermine either an advance (FIG. 2B) or a delay (FIG. 2C) of the modulation cycle with respect to the striking cycle.

In the first case (2B), the needles 8 penetrate into the stripper and into the fibre fleece with a delay time of $\tau_b$ whilst the extraction rollers are already stopped or have passed their point of maximum slowing down. During the withdrawal of the needles, the extraction rollers are again driven. This type of control is adapted for products with a relatively stiff texture implying a penetration of the needles at zero or very low feed speed.

In the second case (2C) the needles 8 penetrate into the stripper and into the fibre fleece with an advance time $\tau_c$ with respect to the time of stoppage or of maximum slowing down of the extraction rollers. This advance allows a withdrawal of the needles at a very low speed of displacement of the fibre fleece.

There will now be described a second feed control method which can be used in a needling machine according to the invention, with reference to FIGS. 3A and 3B. In this second method, the control and processing unit 11 controls the electromechanical drive device 12 in such a way as to obtain a modulation 30 of the feed step P of the needling machine 1 about a constant average feed step Pm. The modulation period is in practice chosen to be equal to a high number k of striking or needling periods Ta, for the purpose of rendering uniform the distribution of the impacts of the needles on the fibre fleece. The striking sequence F comprises elementary striking cycles corresponding to an alternation of high positions H of the needle boards and of low needling positions A. For a given striking frequency, the feed step P is directly proportional to the average feed speed and therefore to the average speed of rotation of the extraction rollers which can be adjusted without difficulty in a needling machine according to the invention.

It is also possible to provide for the combination of the control methods which have just been described, as illustrated in FIG. 4. The angular velocity ω then has a double modulation: a first modulation 40 is carried out at a first modulation frequency equal to the striking frequency (period Ta) and corresponds to a cyclic slowing down or stoppage synchronous with the needling, while a second modulation 31 affects the average angular velocity and corresponds to a second modulation frequency which is generally very low in comparison with the striking frequency and equal to the modulation frequency of the feed step P about the average step Pm.

The invention is not of course limited to the example embodiments which have just been described and numerous modifications can be applied to these examples without departing from the scope of the invention. Thus, the extraction rollers can be driven by any type of motor or motor-reduction unit without any design limitation other than the necessity of having sufficient performance available in terms of the torque/inertia ratio. It is thus possible to consider a drive by variable reluctance motors or by hybrid motors. Furthermore, it is also possible to provide devices for the indirect mechanical driving of the extraction rollers from a single motor-reduction unit. The modulation waveforms can be adapted to the products to be needled, to the sought rates and to the type of needling selected.

We claim:

1. A needling machine comprising means for needling, according to a variable striking frequency, a fibre fleece generally passing between two perforated steel plates, insertion means comprising a first pair of rollers for inserting the fibre fleece between the two plates, a second pair of rollers for extracting the fibre fleece emerging from the plates, means for driving the needling means with a periodic striking motion, means for driving the extraction rollers to be synchronized with the periodic motion of the needling means and at a frequency equal to the striking frequency, said means for driving the extraction rollers comprising electromechanical means and control and processing means, said electromechanical means and said means for driving the needling means being controlled by said control and processing means, wherein said insertion means are driven for inserting the fibre fleece at an approximately constant insertion speed while said extraction rollers are driven at a speed modulated about an average extraction speed, said modulation being of variable amplitude.

2. The needling machine according to claim 1, characterized in that the electromechanical means and the control and processing means cooperate in order to produce in each striking period a stopping sequence of the extraction rollers corresponding to discontinuous feed conditions of the fibre fleece, said stopping sequence substantially coinciding with a needling sequence.

3. The needling machine according to claim 2, wherein said insertion means operate at a given average feed speed which is below an upper limit feed speed, and associated with an average striking frequency which is below an upper limit striking frequency, and characterized in that the discontinuous feed conditions correspond either to a striking frequency lower than said limit striking frequency for a given average feed speed, or to an average feed speed lower than said limit feed speed for a given striking frequency.

4. The needling machine according to claim 3, characterized in that for said average striking frequency and feed frequency corresponding to continuous feed conditions, the rotating electromechanical means and the control and processing means cooperate in order to procure a modulation of the angular velocity of the extraction rollers, this modulation comprising a slowing down sequence substantially coinciding with a needling sequence.

5. The needling machine according to claim 1, wherein the fleece is subjected to a sequential displacement defined by a feed step, the rotating electromechanical means and the control and processing means cooperate in order to procure a modulation of the feed step of the fibre fleece about an average feed step according to a modulation frequency which is a sub-multiple of the striking frequency.

6. The needling machine according to claim 1, wherein the electromechanical means includes electronic converter means and motor reduction means said electromechanical means include a servo-controller for driving and positioning said extraction rollers.

7. The needling machine according to claim 1, characterized in that the electromechanical means comprise direct drive motors for driving the extraction rollers.

8. A method for controlling the feed of a fibre fleece in a needling machine, comprising providing means for needling, according to a variable striking frequency, a fibre fleece generally passing between two perforated steel plates, said fleece being inserted between said plates at an insertion end of the plates, and emerging from the plates at an extraction end opposite said insertion end, from which said fleece is extracted, providing a first pair of rollers for inserting the fibre fleece between the two plates, providing a second pair of rollers for extracting the fibre fleece emerging from the plates, providing means for driving the needling means with a periodic striking motion, providing electromechanical drive means for driving the extraction rollers in synchronized fashion with the periodic motion of the needling means and at a frequency equal to the striking frequency, providing control and processing means for controlling the electromechanical drive means and the means for driving the needling means, said method further comprising providing a servo-control of the position of the extraction rollers of the needling machine and an adjustment of their angular velocity by the electromechanical drive means and the control and processing means, said electromechanical drive means and the control and processing means being configured for driving the extraction rollers at a speed modulated about an average extraction speed, said modulation being of variable amplitude, while said first pair of insertion rollers is driven at an approximately constant insertion speed.

9. The method according to claim 8, characterized in that the adjustment of the angular velocity comprises a modulation about an average angular velocity, said modulation having a modulation frequency equal to the striking frequency and being carried out in synchronism with the periodic motion of the needling means such that the needling of the fibre fleece substantially coincides with a slowing down phase of the feed of the latter.

10. The method according to claim 9, characterized in that the modulation of the angular velocity has an amplitude such that the angular velocity of the extraction rollers is eliminated during the needling sequence of the fibre fleece.

11. The method according to claim 9, characterized in that it furthermore comprises an adjustment of a phase shift between the angular velocity modulation cycles and the striking cycles.

12. The method according to claim 8, characterized in that it furthermore comprises a modulation of the feed step of the fibre fleece about an average feed step, this modulation being carried out at a step modulation frequency which is a sub-multiple of the striking frequency of the needling machine.

13. The method according to claim 12, characterized in that it furthermore comprises a double modulation of the angular velocity of the extraction rollers comprising a first modulation at the striking frequency about an average angular velocity and a second modulation, at the step modulation frequency, of this average angular velocity.

14. The needling machine according to claim 5, characterized in that the modulation of the feed step is substantially sinusoidal.

* * * * *